United States Patent [19]

Madl, Jr.

[11] Patent Number: 4,899,497

[45] Date of Patent: Feb. 13, 1990

[54] FOUNDATION SYSTEM AND DERIVATIVE BRACING SYSTEM FOR MANUFACTURED BUILDING

[76] Inventor: Jos. Madl, Jr., 2161 Vista Entrada, Newport Beach, Calif. 92660

[21] Appl. No.: 144,421

[22] Filed: Jan. 15, 1988

[51] Int. Cl.[4] ..... E04D 15/00

[52] U.S. Cl. ..... 52/126.6; 52/169.9; 52/299

[58] Field of Search ..... 52/299, 126.6, 126.7, 52/263, DIG. 11, 693, 169.9, 143, 292, 79.1

[56] References Cited

U.S. PATENT DOCUMENTS

| | | | |
|---|---|---|---|
| 3,750,349 | 8/1973 | Deike | 52/292 X |
| 3,826,057 | 7/1974 | Franklin | 52/693 X |
| 3,828,491 | 8/1974 | Koon et al. | 52/126.7 X |
| 3,902,289 | 9/1975 | Dashew | 52/126.7 |
| 3,927,498 | 12/1975 | Benedetti | 52/79.1 |
| 4,026,076 | 5/1977 | Analetto | 52/143 X |
| 4,037,835 | 7/1977 | Forsyth | 52/292 X |
| 4,102,096 | 7/1978 | Cody | 52/126.7 |
| 4,106,256 | 8/1978 | Cody | 52/126.7 X |
| 4,122,645 | 10/1978 | Tooley | 52/126.7 X |
| 4,125,975 | 11/1978 | Soble | 52/DIG. 11 X |
| 4,214,410 | 7/1980 | Mitsueda . | |
| 4,229,919 | 10/1980 | Hughes | 52/299 X |
| 4,261,149 | 4/1981 | Gustafson . | |
| 4,348,843 | 9/1982 | Cairns et al. | 52/299 X |
| 4,417,426 | 11/1983 | Meng . | |
| 4,546,581 | 10/1985 | Gustafson | 52/126.6 X |
| 4,546,591 | 10/1985 | Beltz | 52/693 X |

OTHER PUBLICATIONS

SAFE—T BEAM Brochure.

*Primary Examiner*—Carl D. Friedman

*Attorney, Agent, or Firm*—Knobbe, Martens, Olson & Bear

[57] ABSTRACT

A plurality of spaced, rigid rectangular frames that are vertically adjustable are employed to support manufactured buildings. The frames are formed of pedestals interconnected by vertical trusses. The upper ends of the frames, above the support pedestals are clamped to the flanges of I-beams of the building chassis so as to prevent the building from shifting relative to the foundation.

12 Claims, 8 Drawing Sheets

Fig. 1
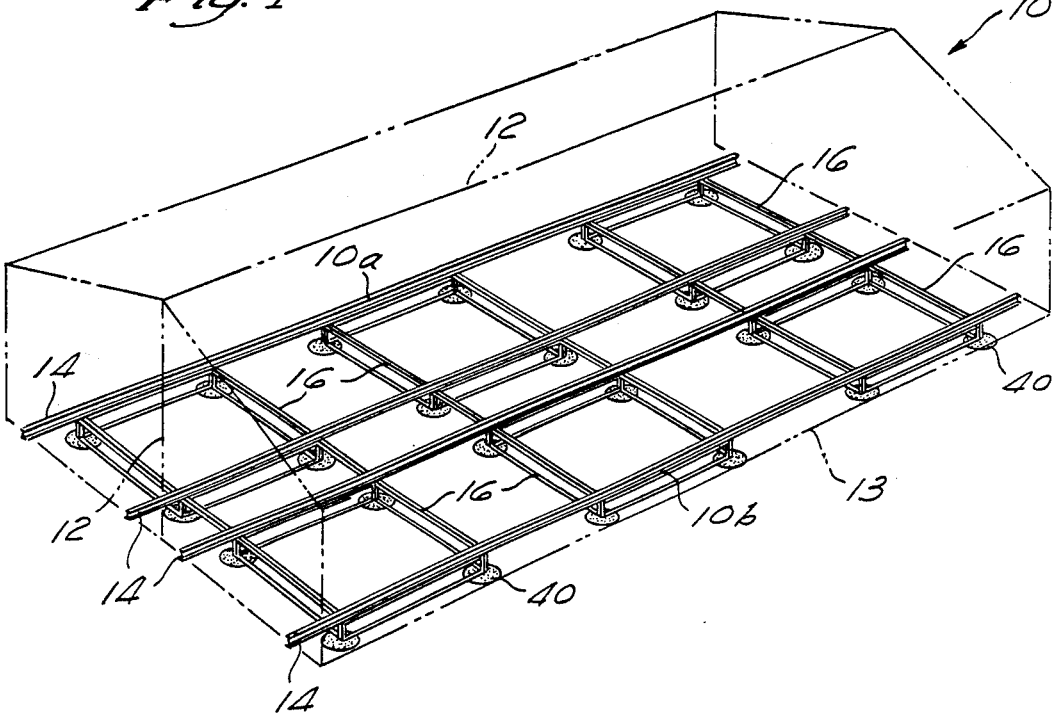
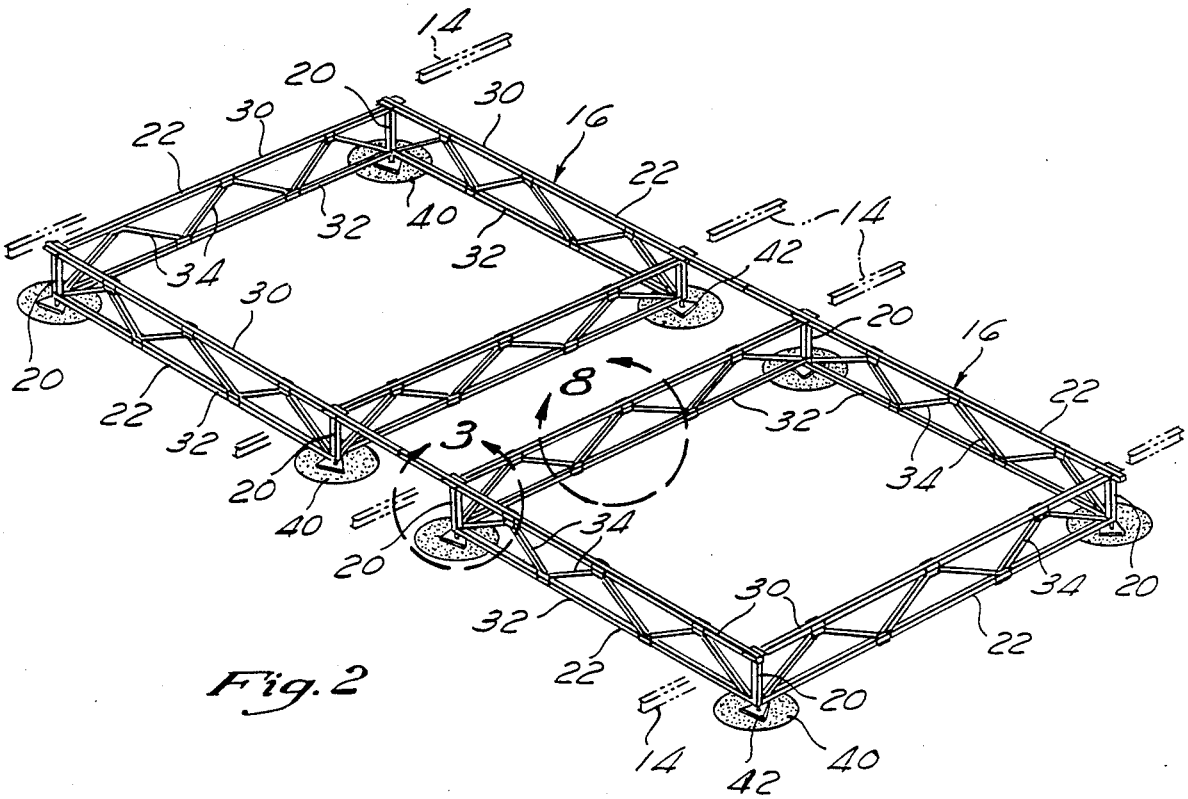
Fig. 2

Fig. 9
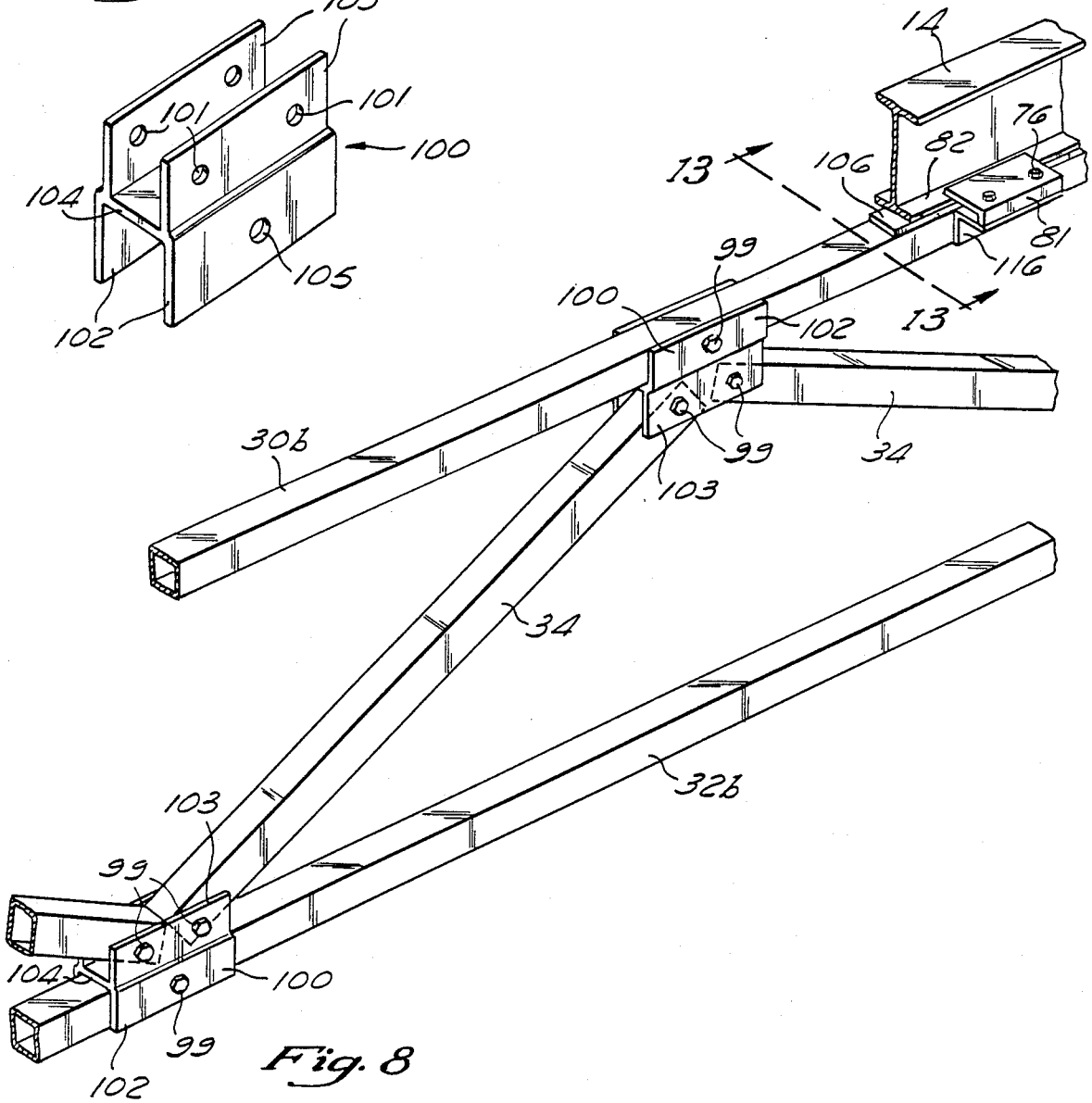
Fig. 8
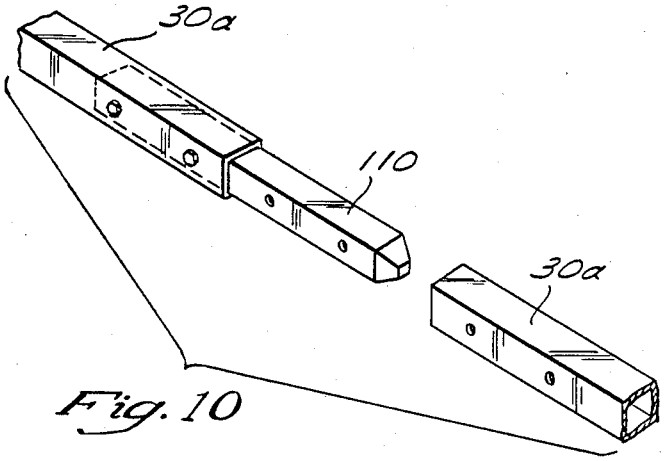
Fig. 10
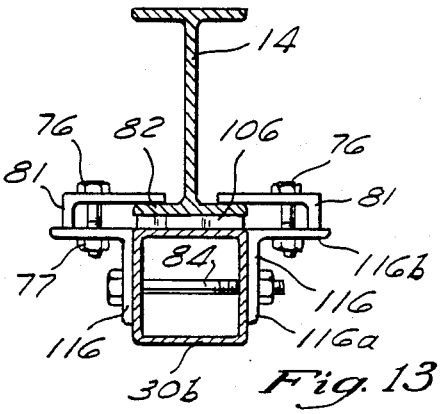
Fig. 13

Fig. 19
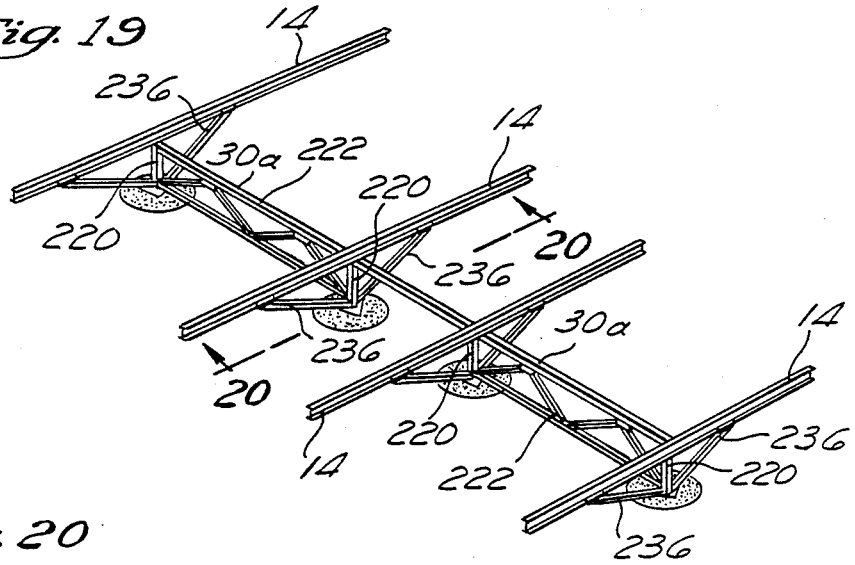
Fig. 20
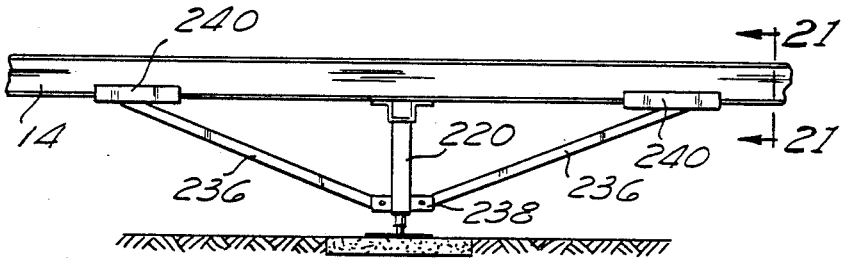
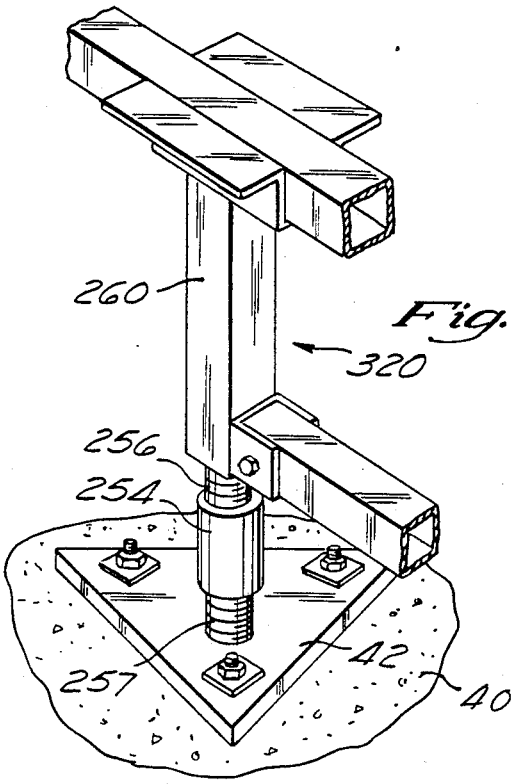
Fig. 22
Fig. 21
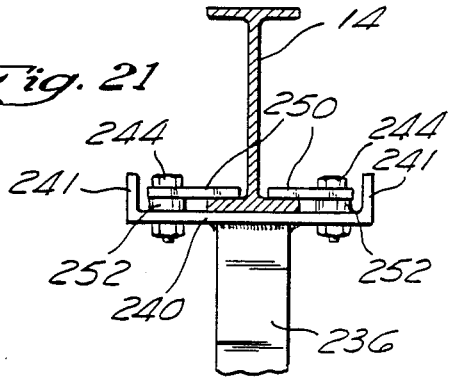
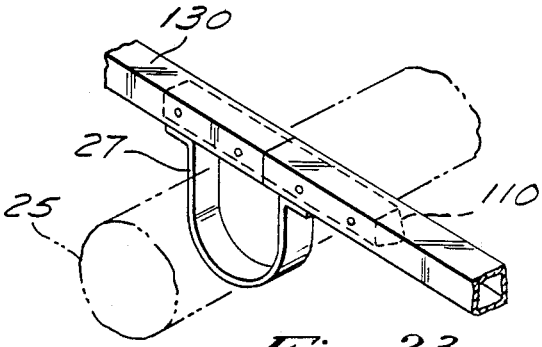
Fig. 23

Fig. 24
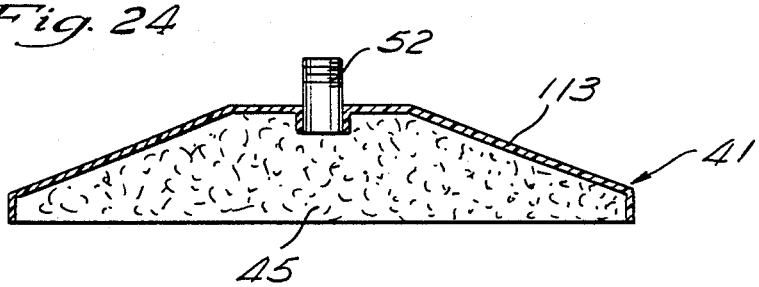
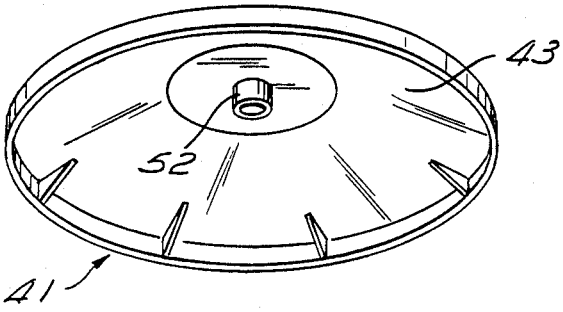
Fig. 25
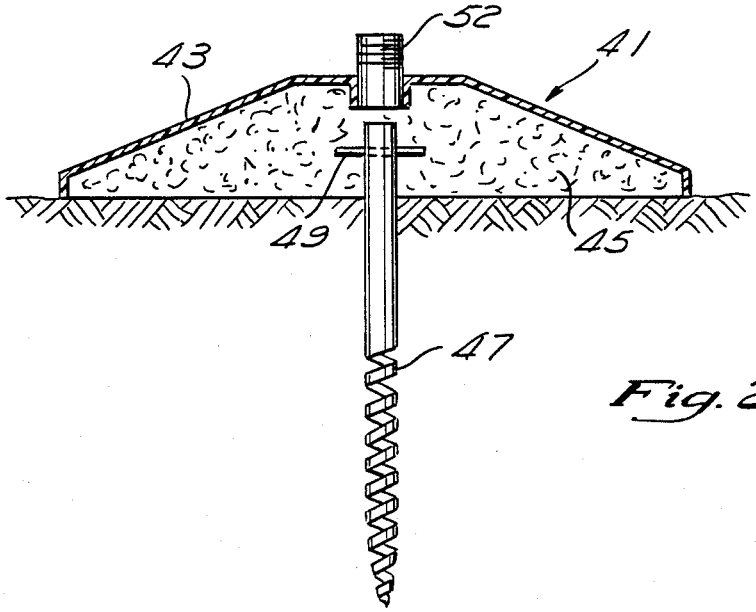
Fig. 26

FOUNDATION SYSTEM AND DERIVATIVE BRACING SYSTEM FOR MANUFACTURED BUILDING

BACKGROUND OF THE INVENTION

The present invention relates to foundation systems for supporting manufactured buildings, and more particularly, to a foundation system capable of withstanding high external forces caused by dangerous earthquakes and high winds, thus preventing damage to the home or injury to its occupants.

Several types of mobile home or manufactured building support systems are known in the prior art. Usually, such buildings are supported by light gauge metal piers, pads, or stanchions. The building is towed to the site and placed on piers aligned under the frame of the mobile home. That support system, as well as other similar support systems rely solely upon the compressional force or weight of the mobile home to hold it on the concrete pier or pad. These piers are extremely unstable when subjected to lateral or horizontal movement, and thus such systems allow shifting of the mobile home, particularly during earthquakes or high winds, whereby the mobile home moves and falls off the support. This can result in its piers piercing the flooring of the building, causing external damage both to the structure itself and utility connections. Similarly, concrete block support systems provide little protection against lateral forces.

Various other support systems have attempted to restrain the mobile home from shifting. One such system is disclosed in U.S. Pat. No. 4,214,410 which uses a plurality of stanchions connected together by a plate which would receive the wheel drum of the mobile home so that the lugs on the wheel drum could be affixed to the plate. However, many mobile homes, particularly those without wheels, cannot be supported in such a way.

Another type of support system is disclosed in U.S. Pat. No. 4,261,149 which has pedestals aligned under the support beams of the mobile home and braced in perpendicular directions. The problem with this system, and others known in the prior art, is that the system must be specially fitted to each mobile home, a time consuming and laborious task usually done at the site. Moreover, that system presumes that it will rest on a substantially level earth surface, and also fails to take into account uneven settling of the earth surface caused by the home after it has been installed onto the system.

Other types of support systems have attempted to solve the problems caused by uneven and settling earth surfaces. For example, U.S. Pat. No. 4,417,426 discloses in FIG. 6 a vertically adjustable foundation system. However, an adjustment requires disconnecting the crossbracing of the pedestal supports. Moreover, because the adjustment requires reconnecting the cross members, the vertical increments are not variable, but extremely limited. The adjustment procedure is difficult to perform at the site.

Thus, there remains a need for an effective foundation system which can withstand earthquake and high wind forces and still have sufficient adjustability to account for varying earth surfaces. Further, such system should provide automatic coordinated leveling and the integration of all components to act as a single unit. In addition, there is a need for a foundation system which can be economically manufactured off the site and which minimizes the time and effort required to install the system at the site.

SUMMARY OF THE INVENTION

Briefly stated, the foundation system of the invention utilizes pedestals with a truss extending horizontally between a pair of pedestals so that a pair of pedestals and the truss form a strong rigid vertically extending rectangular frame. The trusses include a pair of vertically spaced, horizontally extending support members that are interconnected by a plurality of diagonally extending braces. The pedestals include bases that engage concrete pads or other footing and these pads are joined to the pedestals by vertically adjustable connections. Since these connections are below the truss and independent of the truss, the basic frame formed by the pedestals and the truss is not disturbed with vertical adjustment of the pedestal. With this arrangement, the pedestals can be adjusted to accommodate different levels of terrain or footings and the upper ends of the pedestals made dead level to engage the I-beams beneath the manufactured building. Clamps are employed to secure the upper ends of the pedestals to the I-beams to prevent separation of these components during earthquake or wind forces. This basic assembly can be used as a support beneath existing manufactured homes as well as new ones. If a single truss and pair of pedestals are used by themselves, suitable braces are provided which extend from the pedestal perpendicular to the truss, for securing to the I-beam at a point spaced from the pedestal. Advantageously these components are factory manufactured and factory preassembled to precise tolerances requiring minimal field connection at the building site.

In a preferred form of the invention, a horizontally extending, rectangular frame is formed utilizing a pedestal at each corner of the frame with a truss extending between each adjacent pair of pedestals. The components forming this frame are manufactured to precise tolerances so that they will fit very accurately when assembled in the field. The horizontal frame is very strong and rigid and is able to withstand forces in any lateral direction as well as being able to handle vertical loads.

These frames are conveniently sized such that three of the frames spaced from each other can support a housing section that may be up 60 feet long. If a pair of such sections are to be joined to make a double-wide unit, three additional rectangular frames are employed, and the upper members of the truss members that extend laterally perpendicular to the beams beneath the manufactured building are joined in the same horizontal plane to provide a continuous integral frame. This further enhances stability and causes the foundation and the total building of two or more units to act as one.

These transversely extending truss members are positioned within a U-shaped clevis or channel on the upper end of each pedestal. An adjoining upper truss member extending parallel to the I-beam is secured to the upper end of the pedestal by a bolt which extends through the channel, through the truss member within the channel and threads into a fastener on the end of the adjoining truss member. Thus, a single bolt secures both upper members of adjoining trusses to the upper end of a pedestal. One lower truss member is similarly attached to the pedestal by a bolt extending through the pedestal and threaded into a nut secured to the end of that lower truss member. The other lower truss member at that pedestal has its end extending between vertically oriented plates welded or cast with the pedestal, and a bolt extends through these plates and through a precisely located hole in the end of that truss member.

One end of an H-shaped bracket is secured by a bolt to a horizontal member of the truss, and the ends of a pair of diagonally extending braces between the truss horizontal members are secured to the other end of such bracket by a separate bolt through each of such brace ends.

In its preferred form, the adjustable connection for each pedestal includes a lower threaded member rigidly connected to a base member that is secured to a concrete pad. A similar threaded member extends downwardly from the rigid upper portion of the pedestal, and a threaded tubular sleeve cooperates with the mating threaded portions to raise or lower the pedestal.

The pedestals and the trusses are preferably formed from tubular steel members having a square cross section. Such structure provides great strength coupled with minimum weight and precision of assembly.

The pads on which the pedestal bases are supported are preferably in the form of disc-shaped members that can rest directly on the ground. Downwardly and outwardly extending stakes may extend through holes in the pads to more securely position them with respect to the earth. As an alternate arrangement, the pads are positioned on gravel confined within a cylindrical barrier embedded in the earth. The gravel facilitates leveling and adjustment of the pad.

In accordance with the method of the invention, components of the support system are shipped to the building site and assembled into their rectangular frames that are formed of spaced pedestals with trusses extending between the pedestals. A series of such frames are positioned and spaced in parallel relation and the pedestals are adjusted such that the upper ends of the pedestals are dead level and are aligned to be positioned beneath the beam of the building to be supported. With the frames and pedestals so aligned, the building is positioned and slid onto these frames and the upper ends of the pedestals are clamped to the flanges of the I-beam beneath the structure. The pedestals can always be further adjusted as necessary due to any subsequent earth settling.

BRIEF DESCRIPTION OF THE DRAWINGS

FIG. 1 is a perspective view of the support system made according to the present invention in relation to a manufactured building indicated in broken lines.

FIG. 2 is a perspective view of two of the basic supports of the system.

FIG. 8 is a perspective view of a portion of a truss and an I-beam connected thereto.

FIG. 9 is a perspective view of a two-sided clevis.

FIG. 10 is a perspective view of the connection of two upper truss members at the marriage line of two sections of the manufactured home.

FIG. **13*a*** is a plan view of a concrete pad.

Figure 14:
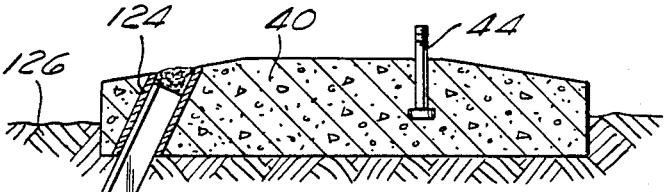

FIG. 14 is a cross section of a concrete pad taken along line 14—14 of FIG. **13*a***.

Figure 15:
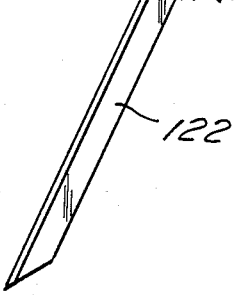
Figure 15:
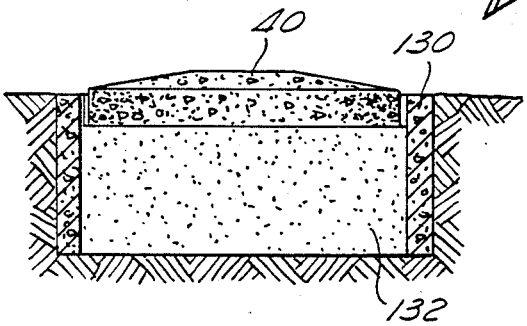

FIG. 15 is an elevational view of a concrete pad and an alternate substrate.

Figure 16:
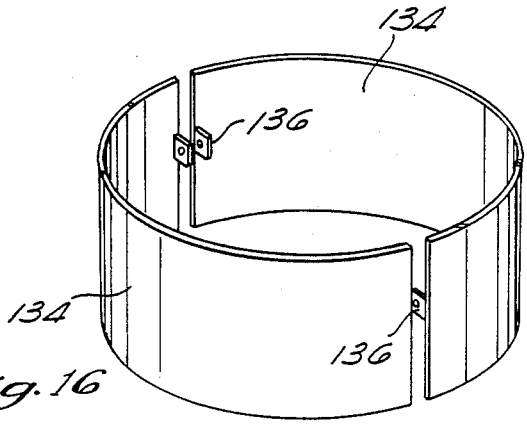

FIG. 16 is a perspective view of an alternative form for confining a substrate beneath a concrete pad.

Figure 17:
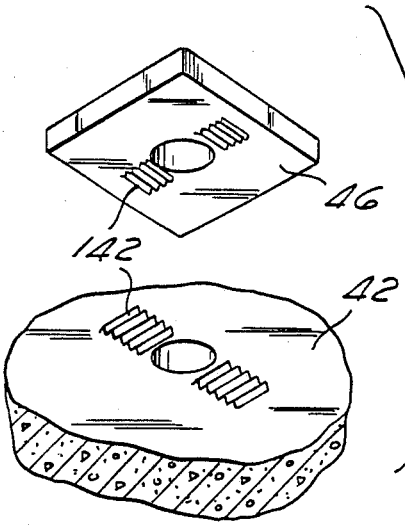

FIG. 17 is a perspective view of a washer and part of a base plate.

Figure 18:
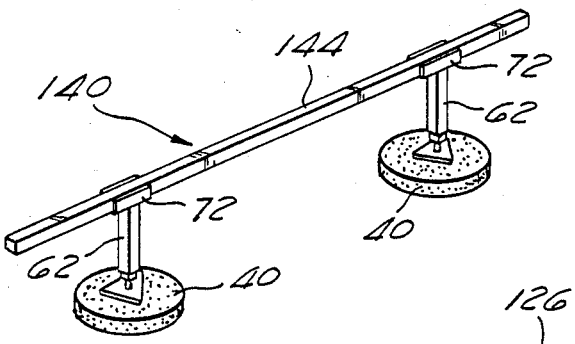

FIG. 18 is a perspective view of a reinforcing structure.

FIG. 19 is a perspective view of a pair of trusses, with pedestal support assemblies forming a portion of a foundation for I-beams of a building.

FIG. 20 is a side elevational view line 20—20 of FIG. 19.

FIG. 21 is a cross-sectional view on line 21—21 of FIG. 20.

FIG. 22 is a perspective view of an alternate pedestal construction.

FIG. 23 is a perspective view illustrating a spliced beam of a truss together with a sewer pipe supporting strap.

FIG. 24 is a cross-sectional view of an alternate form of a pedestal support pad.

FIG. 25 a top perspective view of the pad of FIG. 24.

FIG. 26 a cross-sectional view of a pad of the type illustrated in FIG. 24, together with an auger embedded in the pad.

DETAILED DESCRIPTION OF THE PREFERRED EMBODIMENTS

In FIGS. 1 and 2, the general configuration of a foundation system made according to the present invention is shown. Broken lines in FIG. 1 indicate a manufactured building 10, which is generally constructed in a factory before a foundation system is assembled for it. Typically, the building is formed of two integrated rectangular sections **10*a* and 10*b* that are from 10 to 14 feet wide so that they can be transported on highways. These sections are joined at the building site along the plane formed by the centerline or marriage line 12 midway between the longitudinal sides 13 of manufactured building 10. Attached to the base of the building 10 is a chassis made of a plurality of spaced substantially parallel I-beams 14. Generally, the I-beams 14 extend the entire length of the manufactured building 10**.

As seen, the foundation system includes a basic support unit in the form of rectangular frames or truss systems 16. Six of such frames are shown in spaced parallel relation in FIG. 1, three under each building section. The frames which are side-by-side are joined at the identical horizontal plane to provide a continuous integral structure for two or more building sections. All of the frames are, of course, joined to the beams 14 beneath the building sections. Each truss system 16 is supported by pedestal support assemblies 20 located at the corners of truss system 16. A truss system is comprised of four trusses 22, each truss terminating at each of its ends at a pedestal support assembly 20. Each truss 22 has an upper horizontal member 30 spaced from a horizontal lower member 32 so that the truss forms a plane substantially perpendicular to the ground. Half of the trusses are parallel to the I-beams 14, and aligned substantially within the same vertical plane as an I-beam 14. The other half of the trusses are perpendicular to the I-beams 14, and each of the truss upper members 30 that extends beyond the periphery of a rectangular truss system 16 is connected to another upper member 30 which is part of a truss system 16 located on the opposite side of centerline 12. In addition to an upper member 30 and lower member 32, each truss 22 has a plurality of diagonal members or bases 34 which connect upper member 30 and lower member 32. The bases 34 extend at angle with respect to upper member 30 and lower member 32 to enhance the strength of the truss.

Figure 3:
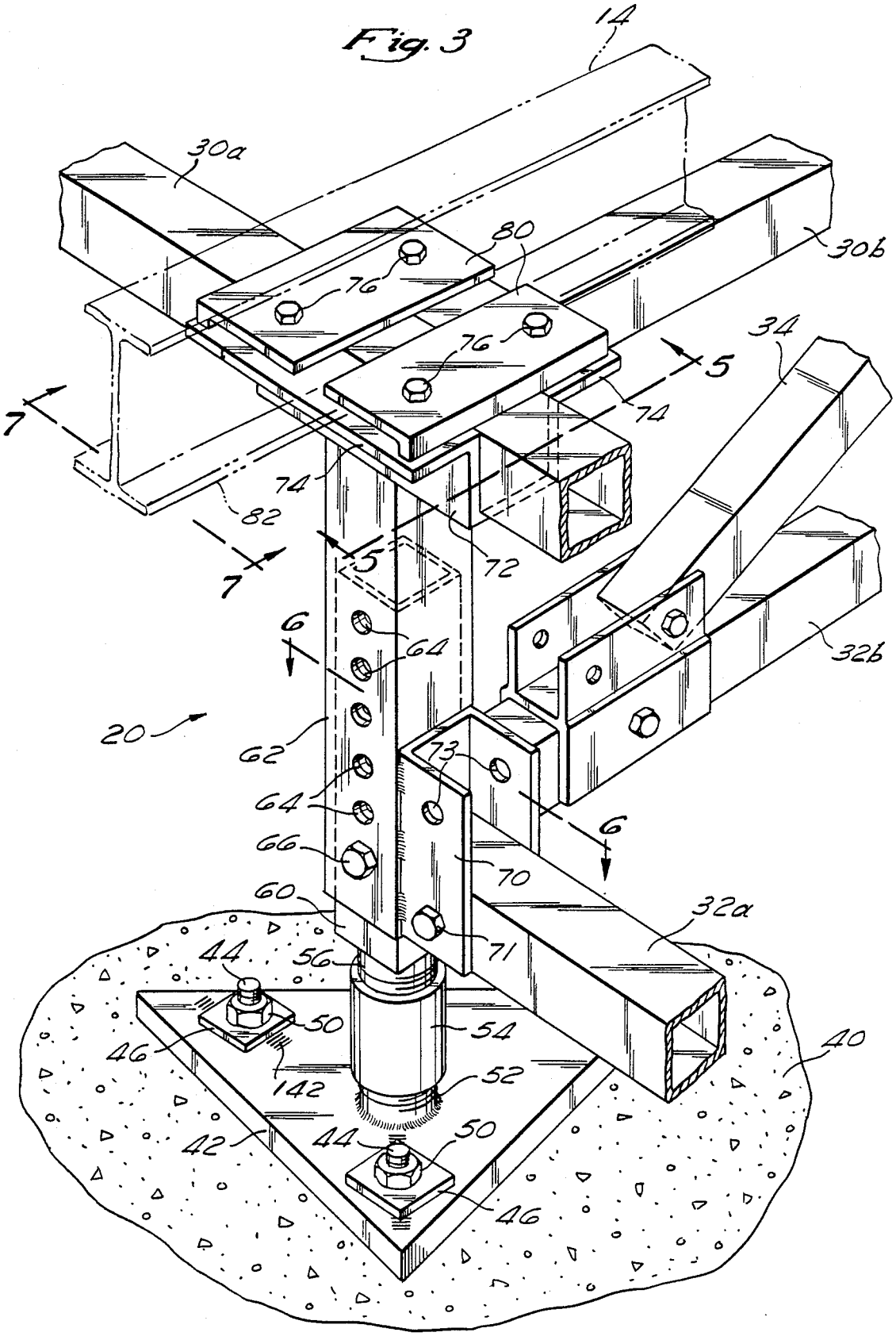
FIG. 3 is a detailed perspective view of a pedestal support assembly and connections thereto.
Figure 4:
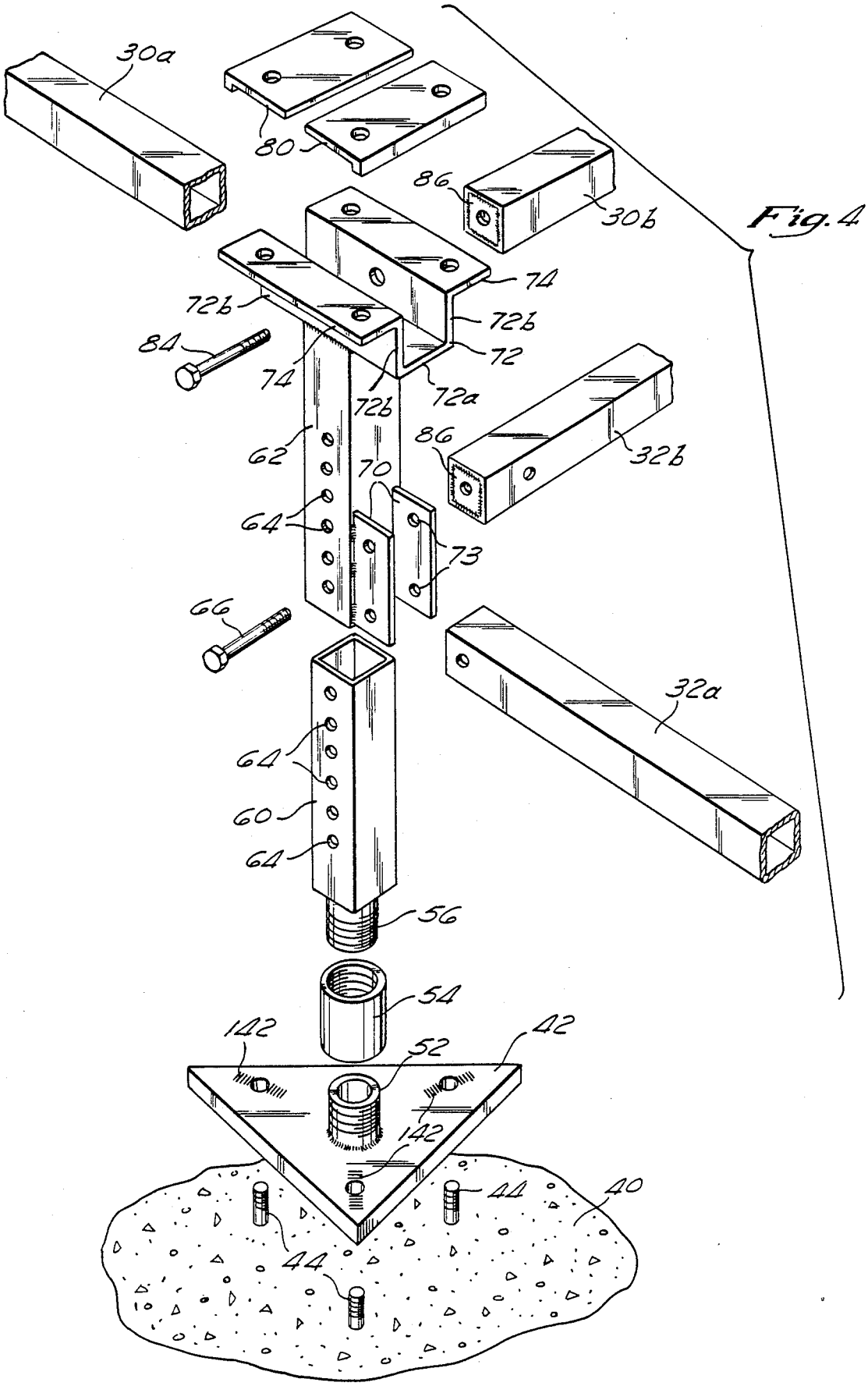
FIG. 4 is an exploded perspective view of the pedestal support assembly of FIG. 3.

Referring to FIGS. 3 and 4 as well as 1 and 2, a pedestal support assembly 20 with its connections for truss 22 and I-beam 14 is shown. Pedestal 20 rests on a concrete pad 40 which is preferably partially embedded in the ground. The base of pedestal 20 comprises a base plate 42 having holes drilled therethrough to allow for proper anchorage to concrete pad 40. Base plate 42, which is preferably made of steel, may form various shapes, FIG. 3 showing a three-sided figure which is believed to be the most economical. Through the holes of base plate 42 run a plurality of anchor bolts 44 having their lower ends encased in concrete pad 40 and their upper threaded ends extending upwardly through the base plate, as seen in FIG. 14. Bolts 44 are long enough so washer 46 and nut 50 may be attached to secure the plate to the pad. Washer 46 must be large enough to minimize the risk of a local failure of base plate 42 around the area of bolt 44. Moreover, washer 46 is preferably thick enough to withstand crushing by tightly affixed nut 50. In addition, it is preferable that the holes in the base plate be oversized to allow for lateral adjustment, and that there be some friction between base plate 42 and washer 50 to prevent shifting from a selected position. FIG. 17 shows in detail one construction for accomplishing this wherein a serrated teeth 142 are embedded within the base plate and the underside of the washer in a matching configuration so that when placed against each other, the teeth will interlock and thus prevent the connection from sliding.

Substantially near the center of base plate 42 is welded upwardly extending, externally threaded pipe 52. Attached to threaded pipe 52 is an internally threaded sleeve 54 of sufficient length so as to be able to receive an upper externally threaded pipe 56 and still have additional length for adjustment. The threads on pipe 56 run opposite those of pipe 52, and the sleeve has opposing threads on each end so that when sleeve 54 rotates, the two threaded pipes will move vertically relative to each other. As a result, the foundation system can be adjusted vertically to take into account uneven ground and gradual ground settling over time the foundation system is in use.

The upper end of second threaded pipe 56 is welded to the center of the base of interior, lower column 60. Because it is economically preferable to use hollow members and columns throughout this design, a plate (not shown) may first have to be attached to the lower end of the lower column 60 before welding the threaded pipe 56. Lower column 60 is partially axially within upper column 62. In the embodiment shown in FIG. 3 in which sleeve 54 may not provide sufficient vertical adjustability, a plurality of transversely extending holes 64 are provided through interior column 60 and exterior column 62 so that a pedestal bolt 66 can pass through both columns. Therefore, by removing temporarily pedestal bolt 66, pedestal 20 can be adjusted vertically in larger increments than by rotating sleeve 54. When the pedestal 20 is at an approximate desired height, pedestal bolt 66 is positioned through columns 60 and 62. Sleeve 54 provides finer vertical adjustability.

Also shown in FIGS. 3 and 4 is clevis 70 which is welded to a side of exterior column 62 with its end wall engaging the column. Clevis 70 has two holes 73 through each of its parallel legs to receive bolts 71 for connecting lower truss member **32*a* and diagonal brace 34. In the upper hole, diagonal brace 34 is connected. In the lower hole, lower member 32*a*** is connected. The holes are sufficiently spaced to accommodate both members.

Welded to the upper end of upper column 62 is a U-shaped channel or clevis 72 which has outwardly extending flanges or wings 74. As seen, the end wall **72*a* of the channel is welded to the column 62 while the spaced channel legs 72*b* extend vertically and are open at the upper end. Channel 72 has an interior width between its legs 72*b* great enough to receive upper truss member 30*a* which is perpendicular to I-beam 14. Thus, channel 72 is also aligned perpendicularly with respect to I-beam 14. Wings 74 have a plurality of holes therethrough for bolts 76 which affix a pair of clamps 80. Clamps 80 secure a lower flange 82 of I-beam 14 indicated in broken lines in FIG. 3**.

Figure 7:
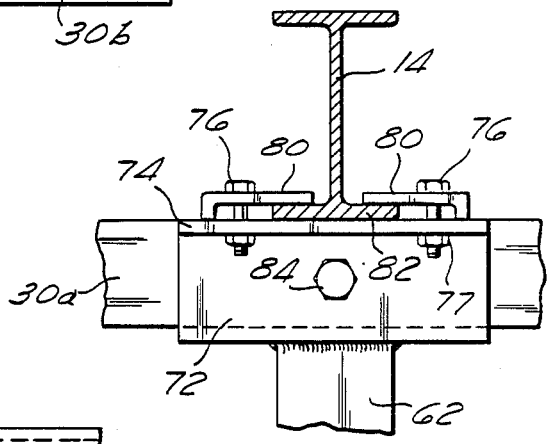
FIG. 7 is a cross section of a main building I-beam taken along line 7—7 of FIG. 3.

As seen in FIG. 7 the upper member **30*a* and the wings 74 of channel 72 preferably form a substantially flat surface for I-beam 14 to rest thereon. The clamps 80 have a substantially L-shaped cross section with a long leg engaging the upper surface of the beam lower flange 82. A shorter leg of the clamp 80 extends substantially perpendicular to and engages the wing 74 and upper member 30*a*. A clamp 80 is clamped in that position by bolt 76 extending through holes in wing 74** and the clamp's longer leg.

Figure 5:
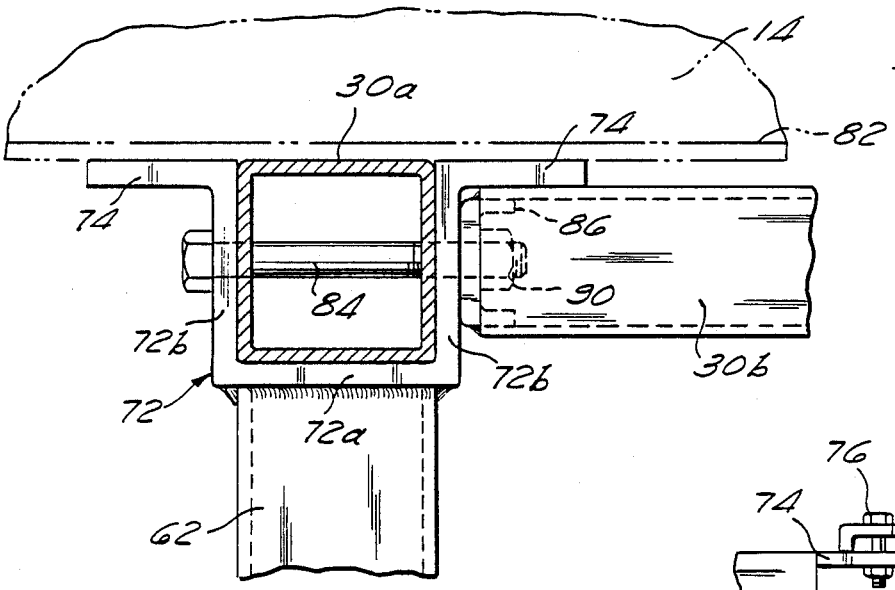
FIG. 5 is a cross section of an upper member of a truss taken along line 5—5 of FIG. 3.

FIG. 5 shows more clearly the connection of two upper members 30 to pedestal support assembly 20. It should be noted that the upper member **30*a* has a rectangular, tubular cross section and fits precisely within the channel with its upper surface substantially flush with the upper surface of the flanges or wings 74. I-beam 14 is shown contacting the upper surfaces of upper member 30*a* and flanges 74**.

Extending through both sides of the upper member **30*a* within channel 72 and through both legs 72*b* of the channel is channel bolt 84. The bolt also extends through plug-like element 86 rigidly connected within the upper member 30*b* which runs parallel to I-beam 14 and perpendicular to channel 72 and member 30*a*. The bolt threads into a nut 90 rigidly secured to the interior surface of the plug 86. Thus, a single bolt precisely joins three components in three different planes, two horizontal and one vertical. The end of upper member 30*b* is positioned so that its top surface is adjacent to the lower surface of wing 74**.

Figure 11:
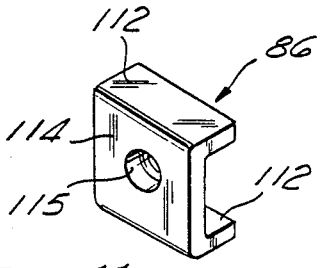
FIG. 11 is a perspective view of a connector for the end of a truss member.
Figure 12:
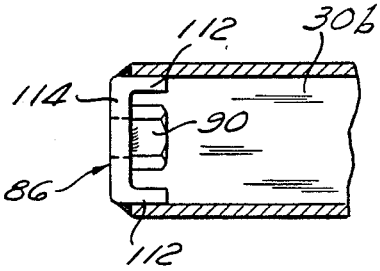
FIG. 12 is a cross section of part of a member in which is positioned an interior connector.

The construction at the end of member **30*b* is more clearly seen in FIGS. 11 and 12. Plug 86 has a pair of spaced parallel stub legs 112 connected at one end to each other by perpendicular back wall 114 to form substantially a C-shaped piece. Preferably, plug 86 is integrally formed and is of such dimensions so as to fit snugly within either upper member 30b or lower member 32b so that it cannot move relative to the members. A bolt hole 115 is located substantially near the center of back wall 114. FIG. 12 shows plug 86 within upper member 30 with the legs 112 contacting the interior walls of upper member 30b so that it is precisely positioned therein. The exterior surface of back wall 114 is substantially perpendicular to the longitudinal axis of the member 30b so that it will come into complete contact with exterior column 62 of pedestal 14 and the plug is precisely located so that the members 30b** are of uniform length within a close tolerance.

Figure 6:
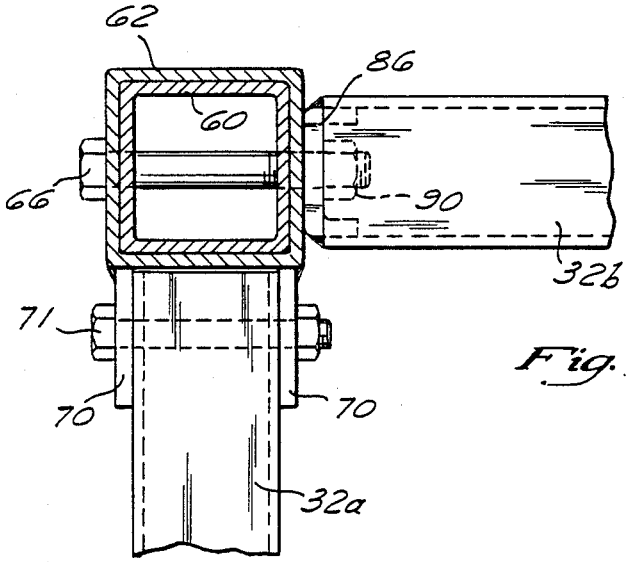
FIG. 6 is a cross section of a pedestal support assembly taken along line 6—6 of FIG. 3.

FIG. 6 shows the connection more clearly of the lower members 32 to the pedestal support assembly 14. The legs of clevis 70 spaced apart to precisely receive the lower member 32a. Bolt 71 passes through each leg of clevis 70 and through precisely located holes in the lower member 32a. Lower member 32b is attached to pedestal 14 by interior connector or plug 86 which is precisely positioned within the end of lower member 32b. Plug nut 90 us preferably welded or peened to plug 86 to facilitate the use of the plug. Pedestal bolt 66 extends through columns 60 and 62, and plug 86, and is threaded into nut 90.

FIG. 8 shows additional detail of a typical truss configuration made according to the present invention. The diagonal braces 34 are attached to the upper and lower members, 30b and 32b, by means of a plurality of generally H-shaped clevises or brackets 100. Bracket 100, as more clearly shown, in FIG. 9 has a pair of parallel legs 103 welded to or integrally cast with the perpendicular center wall 104 to form a clevis on one end for receiving ends of the braces 34, and a pair of spaced parallel legs 102 on the other end forming with the wall 104 a clevis for receiving a member 30b or 32b. The clevis legs 103 have a pair of precisely located holes 101 for receiving the bolts 99 through the end of a pair of braces 34 as indicated in FIG. 8, and the clevis legs 102 include a single hole 105 to receive a bolt 99 through a brace member 30b or 32b. The precise holes permit squared ends on the truss members without the need for costly mitering.

FIGS. 8 and 13 show a portion of I-beam 14 aligned immediately over and connected to the upper member 30b. A spacer 106 is provided between the beam and member 30b to take into account that, at the pedestal 14, wing 74 is between I-beam 14 and upper member 30b. Therefore, to best clamp the I-beam, the spacer 106 is of substantially the same thickness as wing 74. The beam is clamped to the member 30b at spaced locations as desired. I-beam 14 is clamped on its lower flanges by a pair of clamps 81 as similarly done over pedestal 14. Angled brackets 116 are used in cooperation with the clamps 81. A vertical leg 116a of bracket 116 is against one side of upper member 30b while the upper surface of a horizontal leg 116b forms substantially an even or flush surface with the upper surface of upper member 30b. A similar angled bracket 116 is positioned against the other side of the member 30b, and the brackets are attached to opposite sides of upper member 30 by a plurality of bolts 84 passing through the vertical bracket legs 116a against upper member 30b and through the upper member 30b, as shown in FIG. 13. As the clamps 81 engage the wings 74 of channel 72 in FIG. 7, the clamps 81 similarly engage the horizontal legs 116b of brackets 16. However, the shorter leg of the clamp 81, is long enough to accommodate the thickness of the spacer 106. The horizontal leg of clamp 81 engages lower flange 82 of I-beam 14 and has a hole therethrough for bolt 76, which also extends through a hole in the horizontal leg 116b. Tightening nut 77 on bolt 76 affixes clamp 80 and channel 116 and thus secures lower flanges 82 against spacer 106 and hence in turn to the upper member 30b.

FIG. 10 shows an arrangement for connecting upper truss member 30a to another upper member which is part of a truss 22 on the other side of centerline 12. Splice bar 110 is telescopically connected to the members 30a by being slidably positioned within each upper member 30a. Preferably, it has an exterior shape corresponding to the hollow center of the upper members. It has at least one hole for each hole in each upper member 30 so that, once each upper member is horizontally moved toward each other, a bolt can pass through the upper member and bar 110. Preferably, the ends of each upper member will come into contact when connected, thus totally encompassing bar 110. This causes precise alignment of the total framework, and thus also the total building.

Figure 13A:
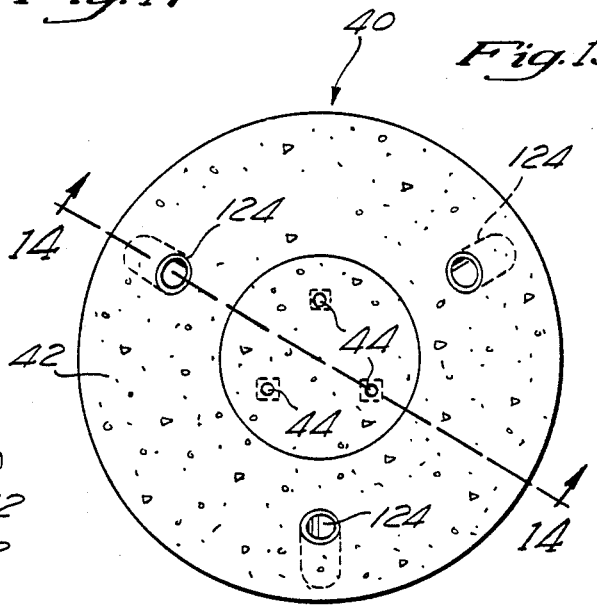
FIG. 13 is a cross section of an I-beam connected to an upper truss member taken along line 13—13 of FIG. 8.

FIGS. 13a through 15 show in detail the construction of concrete pad 40. The pad can be of any shape, though it is preferably circular to minimize the chances of cracking. Although the pad can simply rest on the ground as shown in FIG. 13a, it is preferable that it be more securely positioned. For this purpose, there are shown in FIG. 14 three equally spaced stakes 122 extending through sleeves 124 located adjacent to the periphery of pad 40. The stake 122 is long enough to penetrate the ground 126 so as to prevent the movement of pad 40 relative to the ground. To better accomplish that result, it is preferable that stakes 124 and sleeves 122 diverge outwardly at their lower ends so that the inserted end of the stake extends away from the axis of concrete pad 40 as the stake penetrates the ground, as shown in FIG. 14.

FIG. 15 shows an alternate arrangement wherein a concrete pad is resting on substrate 132 which may be sand, gravel or any other material which settles evenly and minimally over time. To ease the placement of the substrate 132 and concrete 40 into the ground and, to substantially prevent lateral movement, one may use a form 130 of structural concrete pipe, as depicted in FIG. 15. Alternate configuration 134 shown in FIG. 16 is comprised of two semicircular metal sheets each having corresponding links or lugs 136 which may be attached by bolting the lugs together thus forming a tube-like form. The alternate format allows some nesting of the semicircular members for shipping purposes.

FIGS. 24 and 25 illustrate a lightweight alternate construction for a support pad 41 having a generally flattened frusto-conical configuration. This includes an upper and outer shell 43 made of a lightweight but strong material. While various materials may be used, a composite material such as fiberglass is desirable. Preferably, reinforcing ribs 43a are formed in the periphery of the upper shell 43, as seen in FIG. 25. A threaded pipe 52 is embedded in the upper flat central section of the upper shell. Molded within the interior of the upper shell is a strong, structural foam material 45. The combined pad 41 has more strength than concrete and has the great advantage of being much lighter in weight. Consequently, shipment and handling of such components is greatly facilitated. It should be noted that the use of the lightweight pad 41 eliminates the need for the bolts 44 in the upper end of the pad 40 as well as a separate plate 42 in that the pipe 52 is embedded directly into the pad 41.

The pad shown in FIG. 26 is identical to that of FIGS. 24 and 25, except that the upper end of an auger 47 is embedded in the structural foam material 45, with the auger extending downwardly from the lower surface of the pad. The auger is useful for further securing a pad to the ground. The auger will penetrate the ground by rotating the pad. Note that a cross rod 49 extends through the upper end of the auger and into the structural foam material to provide rotational integrity. To facilitate rotation of the pad and the auger, a suitable T-shaped tool (not shown) may be threadably attached to the pipe 52.

FIG. 18 shows a reinforcing structure 140 comprising a pair of vertical adjustable pedestals resting on a pair of concrete pads 40 and attached by a single beam 144. On the upper surface of exterior column 62 is a U-shaped channel 72 for receiving beam 144. The reinforcing structure is useful on home installations when additional support is desired in building floor areas having increased load as a result of a heavy local load.

While the basic rectangular frame shown in FIGS. 1 and 2, that employs four trusses extending between four corner pedestals, provides the preferred supporting unit, a pair of pedestals 220 interconnected by the single truss 222, shown in FIGS. 19 and 20 also provide a residual useful arrangement. Such a unit is shown extending perpendicular to a pair of spaced main I-beams 14 aligned with a second such unit extending perpendicular to a second pair of main I-beams. The upper members 30*a* of these trusses extend beyond the centerline to be joined at a connection of the type shown in FIG. 10. To provide greater stability of such support units in the direction parallel to the I-beams 14, the pedestals are provided with elongated diagonal braces 236. A brace 236 extends from opposite sides of the lower end of the pedestal, upwardly toward the I-beam. The lower ends of the braces 236 are bolted to a pair of plates 238 in a manner similar to that used for the braces extending between the upper and lower truss members.

As seen in FIG. 21, there is provided on the upper end of each of the diagonal braces an elongated channel 240 at a precise angle such that the upper interior surface of the channel flat bottom wall or plate meets flush with the lower surface of the beam 14. The width of the channel is considerably greater than the width of the I-beam so that the channel can be provided with holes on each side for receiving bolts 244 that securely hold clamping plates 250 against the upper surface of the I-beam flanges. Spacer washers 252 extend between the lower surface of the plates and the upper surface of the channel to keep the clamp plates approximately parallel to the channel. To increase rigidity and strength the channel is provided with a pair of upwardly extending stub walls 241 on its outer edges thus forming a flattened U-shaped cross section.

FIG. 22 illustrates a simplified and less expensive form of pedestal 320. Instead of using telescoping columns, as in the arrangement in FIGS. 3 and 4, a single non adjustable column 260 is employed. An adjustable threaded connection consisting of a pipe 256, a sleeve 254 and a pipe 257, similar to the components shown in FIG. 3, connect the column 260 to the base plate 42. This adjustable connection is made sufficiently long to provide the desired vertical adjustment through an infinite range of settings between its upper and lower limits. The arrangement of FIG. 22 requires fewer parts than the arrangement of FIG. 3 and consequently has a simpler assembly procedure.

With new installations, sewer and other utility connections are commonly made after the foundation system is installed. Ample space exists between the building and the ground for making the necessary connections. However, for providing improved earthquake and wind bracing for structures already positioned on a desired site with sewer lines in place, it is desirable that arrangements be made to accommodate them without costly disconnection and reinstallation of such lines. The trusses of the type described above can be specially modified to accommodate such existing lines, in a manner illustrated in FIG. 23. More specifically, the upper horizontal member 130 of a truss may be formed in two sections and spliced by an internal guide rod 110 as explained in connection with FIG. 10 above. A similar splice is provided for the lower truss member. Thus these two portions of a truss may be slid together transversely above and below the sewer line 25. A U-shaped strap 27 attached to opposite sides of the splice supports the sewer line at that location.

As will be apparent from the above description, the foundation system described is manufactured in a factory, and the main components assembled in the factory and easily shipped to the building site and with the remaining assembly on the site before the manufactured building arrives. Of course, the components can be assembled at the site if desired. Because of the precision manufacture of the components the trusses and pedestals may be quickly and accurately assembled into the rigid support units illustrated in FIGS. 1 and 2. The concrete pads 42 are seated on the ground or gravel footings in the desired location, and then the pedestal base plates are secured to these pads. The pedestals of the rigid frames are individually adjusted so that the upper surfaces of the frames are dead level before the manufactured building is placed on the foundation system. Also, the pedestals will be located under the building beams when the building is transferred to the foundation system, as shown in FIG. 1. If after the building has been transferred to the foundation system, further vertical adjustment seems necessary of any of the pedestals, this can be done by rotating the adjustment sleeves either manually or with a suitable wrench. Once the vertical adjustment is satisfactory, the clamps referred to above are attached to the flanges of the beam in the manner discussed above.

The finished installation is thus perfectly aligned. Adequate support is provided for the weight of the building, the rectangular frames with their rigid trusses and pedestal units provide adequate support in any horizontal direction, and the clamps between these frames and the building I-beams provide an integral structure between the foundation and the building. Consequently, shifting between the building and the foundation by either earthquake or wind is prevented.

What is claimed is:

1. A building foundation system comprising a pair of spaced, vertically extending pedestals and a truss extending between said pedestals wherein said pedestals and said truss from a vertically oriented rigid frame, said pedestal including an upper portion to which said truss is attached, a base, and a vertically adjustable connection between said base and said upper portion that enables each pedestal to be precisely adjusted vertically so that the upper ends of the pedestal are dead level and yet the pedestals accommodate variations in elevation of the surfaces on which the bases rest, said truss comprises a pair of parallel, transversely extending, vertically spaced members rigidly attached to said pedestal upper portions, and braces extending diagonally between and rigidly connected to said members, a generally U-shaped channel on the top of each of said pedestal upper portions with the open end of the channel facing upwardly, and with the upper one of said truss members being positioned between the legs of the channel, and a bolt extending through the channel and said upper member.

2. The system of claim 1, wherein said channel includes a pair of wings formed integral with the upper ends of the channel legs and extending transversely outwardly from the upper ends of the legs, each of said wings having a flat upper surface, and clamps being adapted to clamp said wings to a building.

3. The system of claim 1, including an elongated brace having a lower end secured to said pedestal upper portion at a location spaced downwardly from the upper end of said pedestal, said elongated brace extending diagonally, upwardly away from said pedestal with the upper end of the elongated brace being spaced from the pedestal at the height of the pedestal, said elongated brace including a flat plate on its upper end adapted to receive clamps for securing the upper end of the elongated brace to outwardly extending flanges on the lower end of a beam.

4. The system of claim 3, wherein said plate is rigidly secured to the upper end of said brace at a precise angle so that said plate is horizontal when in use with the lower end of the brace secured to said pedestal portion at said location.

5. The system of claim 4, wherein said lower end of said brace is pivotally secured to said pedestal to enable the upper end of the brace to be swung upwardly into position with said plate being automatically placed in flush bearing alignment with a beam.

6. A building foundation system comprising a pair of spaced, vertically extending pedestals and a truss extending between said pedestals wherein said pedestals and said truss form a vertically oriented rigid frame, said pedestal including an upper portion to which said truss is attached, a base, and a vertically adjustable connection between said base and said upper portion that enables each pedestal to be precisely adjusted vertically so that the upper ends of the pedestal are dead level and yet the pedestals accommodate variations in elevation of the surfaces on which the bases rest, said pedestal includes a channel having a generally U-shaped cross section with a closed end extending horizontally and fixed to the upper end of said pedestal, a pair of vertically extending legs forming an open upper end, and a an upper transverse member of said truss being positioned within said channel and adapted to be attached thereto by a bolt extending through the legs of the channel and said upper member.

7. The system of claim 6, including a pair of vertically extending plates attached to said pedestal and spaced to receive an end of a lower member of said truss.

8. The system of claim 7 including a second truss extending perpendicular to the first mentioned truss and attached to one of said pedestals, said one pedestal having a pair of holes thereon for receiving a bolt to be threaded into the end of upper and lower members of said second truss.

9. A building support system comprising a generally rectangular frame including at least four spaced vertically extending pedestals, and a truss extending between each adjacent pair of pedestals, each of said trusses includes a pair of vertically spaced, horizontally extending members, and a plurality of braces extending diagonally between each of pair of horizontally members, and clamps secured to the top of said pedestal for attachment to flanges of beams extending beneath the building, said pedestal includes on its upper end a generally U-shaped channel opening upwardly with a pair of upwardly extending legs defining a spaced for receiving the upper one of said pair of truss members, and a bolt extending through said channel legs and said upper truss member to rigidly secure said upper truss member to said channel.

10. A foundation system for a manufactured building comprising a vertically extending pedestal having a channel rigidly secured to its upper end, with the channel having a pair of upwardly extending parallel legs opening upwardly to define a space between the legs, a first vertically extending truss including a lower horizontal member attached to said pedestal and an upper horizontal member having an end portion positioned within said channel, a second vertically extending truss being perpendicular with respect to said first truss and having a lower horizontal member secured to said pedestal and having an upper horizontal member, the end of the upper horizontal member of said second truss having an end surface for engaging the exterior side of one of said channel legs, and a bolt extending through said channel legs and through the upper horizontal member of said first truss to precisely position that upper member, said bolt being threaded into the end of the upper horizontal member of said second truss to thereby secure that member to said pedestal.

11. The system of claim 10, including a pair of clevis plates extending outwardly from the lower portion of said pedestal with the plates being spaced to receive one end of the lower member of said first truss, and a bolt extending through said plates and the lower member of said first truss to precisely secure the lower member of said first truss to said pedestal, and a bolt extending through said lower portion of said pedestal and being threaded into the end of the lower horizontal member of said second truss to thereby secure the lower member of said second truss to said pedestal.

12. The system of claim 10, wherein said channel includes a pair of wings extending horizontally outwardly from the upper end of the legs of said channel for engaging the lower surface of a beam extending beneath said building, and clamps secured to said wings for cooperating with flanges on the end of said beam to secure the beam to the pedestal.

* * * * *